US010207497B2

(12) United States Patent
Cumbie et al.

(10) Patent No.: US 10,207,497 B2
(45) Date of Patent: Feb. 19, 2019

(54) SELECTING NOZZLES

(71) Applicant: HEWLETT-PACKARD DEVELOPMENT COMPANY, L.P., Houston, TX (US)

(72) Inventors: Michael W. Cumbie, Corvallis, OR (US); Garrett E. Clark, Corvallis, OR (US); Mark H. MacKenzie, Corvallis, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/986,593

(22) Filed: May 22, 2018

(65) Prior Publication Data

US 2018/0264806 A1 Sep. 20, 2018

Related U.S. Application Data

(63) Continuation of application No. 15/306,016, filed as application No. PCT/US2014/035402 on Apr. 25, 2014, now Pat. No. 9,994,014.

(51) Int. Cl.
*B41J 2/045* (2006.01)

(52) U.S. Cl.
CPC ..... *B41J 2/04545* (2013.01); *B41J 2/0458* (2013.01); *B41J 2/04581* (2013.01)

(58) Field of Classification Search
CPC ... B41J 2/04545; B41J 2/0458; B41J 2/04581
USPC ..... 347/14
See application file for complete search history.

(56) References Cited

U.S. PATENT DOCUMENTS

| | | | | |
|---|---|---|---|---|
| 6,257,690 | B1 | 7/2001 | Holstun | |
| 6,478,396 | B1 | 11/2002 | Schloeman et al. | |
| 7,032,986 | B2 | 4/2006 | Corrigan | |
| 7,578,569 | B2 | 8/2009 | Silverbrook | |
| 8,649,060 | B2 | 2/2014 | Kuiper | |
| 2002/0008723 | A1* | 1/2002 | Wen | B41J 2/2139 347/19 |
| 2002/0101602 | A1 | 8/2002 | Vilanova | |
| 2004/0032598 | A1 | 2/2004 | Fagan | |
| 2004/0080554 | A1 | 4/2004 | Kim | |
| 2004/0223014 | A1 | 11/2004 | Barr | |

(Continued)

FOREIGN PATENT DOCUMENTS

| | | |
|---|---|---|
| CN | 1680101 | 10/2005 |
| CN | 1715053 | 1/2006 |

(Continued)

OTHER PUBLICATIONS

Technology Overview; Konica Minolta, Inc.,; http://www.konicaminolta.com/inkjethead/technology/technology.html; downloaded Mar. 3, 2014; 4 pp.

*Primary Examiner* — Huan Tran
*Assistant Examiner* — Alexander D Shenderov
(74) *Attorney, Agent, or Firm* — HP Inc.—Patent Department

(57) ABSTRACT

Selecting nozzles can include selecting nozzles of a plurality of nozzles to print a portion of a print job based on content of the print job and assigning firing reservations to the selected nozzles, where a total number of the firing reservations assigned to the selected nozzles is comparatively less than a total number of the plurality of nozzles.

20 Claims, 4 Drawing Sheets

(56) References Cited

U.S. PATENT DOCUMENTS

| | | | | |
|---|---|---|---|---|
| 2007/0091132 | A1 | 2/2007 | Lim | |
| 2007/0064035 | A1 | 3/2007 | McClelland et al. | |
| 2007/0070108 | A1 | 3/2007 | Mantell et al. | |
| 2009/0033694 | A1* | 2/2009 | Shi | B41J 2/2139 347/9 |

FOREIGN PATENT DOCUMENTS

| | | | |
|---|---|---|---|
| CN | 1954999 | A | 5/2007 |
| EP | 1584473 | | 10/2005 |

* cited by examiner

SELECTING NOZZLES

BACKGROUND

Printing devices are widely used and may include a printhead enabling formation of text or images on a print medium. Such a printhead may be included in an inkjet pen or printbar that includes channels that carry fluid. For instance, fluid may be distributed from a fluid supply to the channels through passages in a structure that supports the printhead(s) on the inkjet pen or printbar.

DETAILED DESCRIPTION

Figure 1:
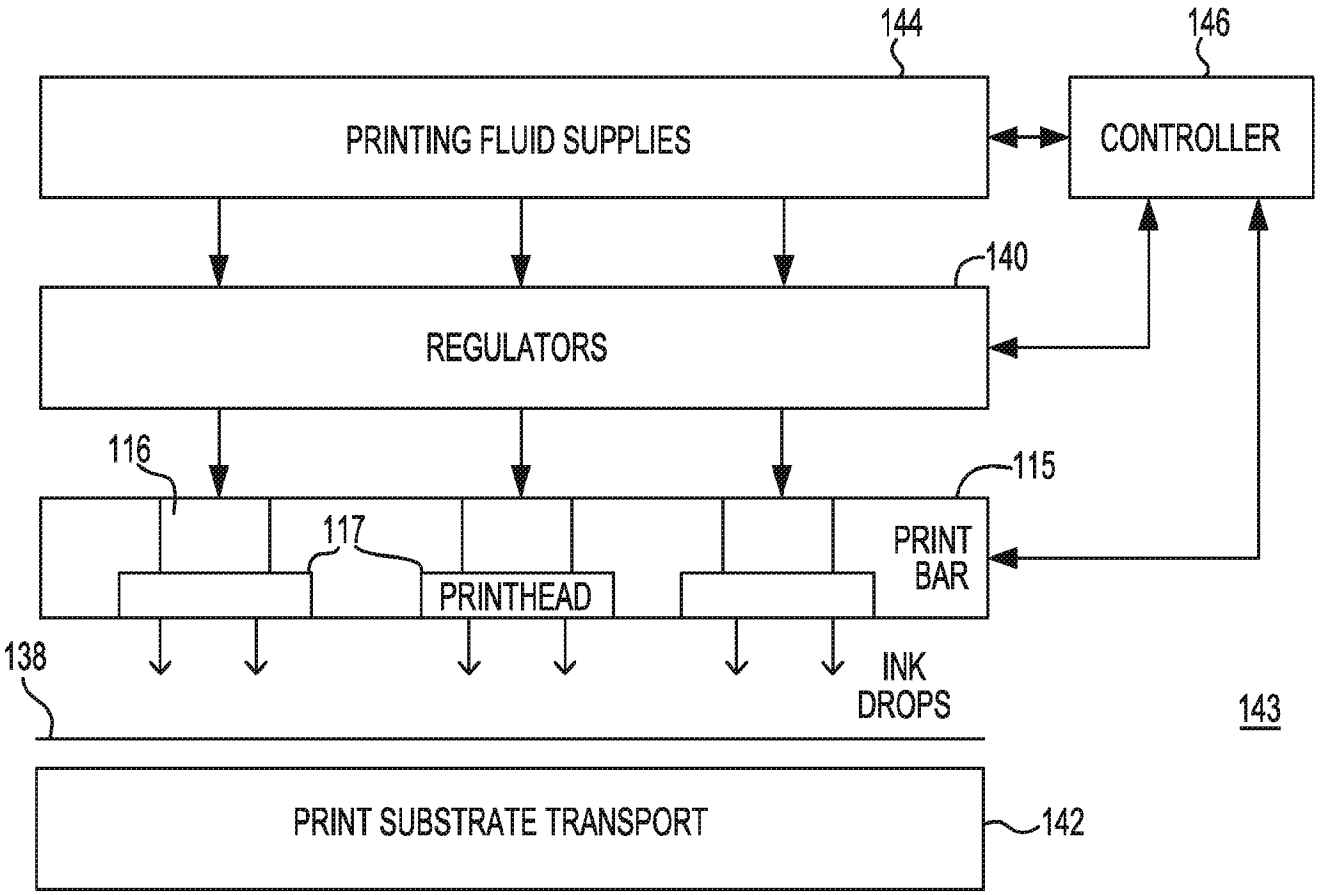
FIG. 1 is a block diagram illustrating a printer implementing an example of a printhead for selecting nozzles according to the present disclosure.

Printers that utilize a printbar assembly (e.g., a substrate wide printbar assembly) have been developed to help increase printing speeds and reduce printing costs. Printbar assemblies often tend to include multiple parts that carry printing fluid from the printing fluid supplies to the printheads (e.g., printhead dies) from which the printing fluid is ejected on to the paper or other print substrate by control circuitry that provides data and/or power to the printhead. It may be desirable to shrink the size of a printhead; however, decreasing the size of a printhead can involve changes to structures that support the printhead including passages that distribute fluid to the printhead and/or circuitry that provides data and/or power to the printhead. While reducing the size and spacing of the printheads continues to be desirable, so doing can actually increase the overall cost associated with a printhead (e.g., due to complex fabrication processes, etc.) and/or reduce performance of the printhead.

Generally, a printer can use a printhead (e.g., a printhead included in a printbar) including a plurality of nozzles (e.g., nozzle orifices) arranged in a primitive, as described herein, to dispense fluid (e.g., ink). The location of a nozzle can be an address. An address can be a location of a nozzle in a primitive and/or on a printhead in general. A number of addresses can be grouped into a primitive. A primitive refers to circuitry (e.g., a repeatable grouping of circuits that can be used to form a print swath) associated with a number of nozzles. For example, a primitive can refer to a threshold amount of area (e.g., nozzle space) of circuitry associated with a number of nozzles. The threshold amount of area can for example be referred to as A (threshold amount of area)=$2^{N}$; where N is a variable chosen upon a desired circuit size, a desired printing speed, and/or a desired amount of power (e.g., a upper bound of an amount of power capable of being applied to nozzles associated with circuitry of the primitive). A primitive can include a particular number of addresses (e.g., 32 addresses) and/or can be located at a die level of a printer.

Firing chambers can be associated with an address to eject fluid. The firing chambers can be fired in a particular firing order. However, due to various practical considerations, rarely, if ever, are all of the nozzles on a printhead and/or printbar fired at the same time while printing a print job and/or a portion of a print job (e.g., a page). For instance, firing all nozzles at the same time may result in an excess of fluid being applied to a print substrate, undesired fluid placement, and/or undesired physical change(s) to the print substrate (e.g., the print substrate becoming saturated with fluid). Despite every nozzle of the plurality of nozzles included in a printhead and/or printbar not being used at a given time, data, for instance, firing reservations, may be sent to each nozzle of the plurality of nozzles (e.g., sent to every pixel row) for a given firing sequence (e.g., before printing a page of a print job corresponding to the given firing sequence) and/or a given time. In this way, each nozzle of the plurality of nozzles has a pre-determined firing reservation and can either be fired or not fired at a time associated with the firing reservations. Such an approach may have a large amount of circuitry and/or a large number of firing reservations due to sending firing reservations to each of the nozzles, regardless of whether or not the nozzle is fired during a print job and/or firing cycle.

In addition, the above approach of sending firing reservations to each nozzle regardless of whether it is ultimately fired (e.g., fired as part of printing a print job) may result in undesirably predictable non-simultaneous nozzle firing such that a target location of each dot produced by a nozzle on the page is fixed regardless of changes in content to be printed. Techniques such as nozzle "stagger" may attempt to account for such undesirably predictable non-simultaneous nozzle firing, for example, by firing nozzles to allow each nozzle, in turn, to be fired at an intended target location (e.g., directly at the center of its intended pixel). However, such techniques may have undesired effects such as a dot placement error (e.g., an error in placement of a dot from an intended target location), be complex and/or ineffective, among other disadvantages. For example, a dot placement error may be proportional to a timing spread or other factors associated with the nozzle firings of the above techniques.

In contrast, examples of the present disclosure include methods, systems, drive circuits, and computer-readable and executable instructions for selecting nozzles. Selecting nozzles refers to selecting nozzles of a plurality of nozzles to print a portion of a print job based on content of the print job and assigning firing reservations to the selected nozzles where a total number of the firing reservations assigned to the selected nozzles (e.g., at a given time) is comparatively less than a total number of the plurality of nozzles. Advantageously, selecting nozzles allows the firing sequence of a plurality of nozzles to vary for each firing cycle (e.g., each page of a print job) and/or utilizes a comparatively smaller amount of firing reservations (e.g., bandwidth) than other approaches, among other advantages.

FIG. 1 is a block diagram illustrating a printer implementing an example of a printhead according to the present disclosure. Referring to FIG. 1, a printer 143 (e.g., an inkjet printer) includes a printbar 115 spanning the width of a print substrate 138, flow regulators 140 associated with the printbar 115, a substrate transport mechanism 142, ink or other printing fluid supplies 144, and a printer controller 146. The print controller 146 represents programming, processor(s) and associated memories, electronic circuitry, and/or other components to control operative elements (e.g., a printhead 117) of the printer 143. The print controller 146 can control various operations of the printer 143. The print controller 146 can be defined by or include a processor resource configured to operate in accordance with a machine-readable program code, an ASIC, a state machine, and so on. Other constituency can also be used. The print controller 146 includes circuitry (not shown), having one or more resources in accordance with the present teachings. The print controller 146 thus includes circuitry of the present teachings directed to selecting nozzles.

The printbar 115 includes an arrangement of printheads 117 to dispense printing fluid on to a sheet or continuous web of paper or other print substrate 138. As described in detail below, each printhead 117 includes a plurality of nozzles arranged in a primitive. While FIG. 1 illustrates a page wide printbar 115 including three printheads 117 the present disclosure is not so limited. That is, the print bar can span an area greater than or less than a print substrate and/or include fewer (e.g., one) or more than the three printheads illustrated in FIG. 1 to promote selecting nozzles.

The printhead 117 can be formed of semiconductor material (e.g., silicon) and can include integrated circuitry (e.g., transistors, resistors, etc.). Each printhead 117 includes fluid feed holes, thin-film layer (including firing chambers), and conductors. A slot feeds printing fluid directly to the printhead (e.g., printhead die(s)), such as to fluid feed hole(s) included in the printhead 117. The fluid feed holes provide printing fluid (e.g., ink) to fluid ejectors formed in the thin-film layer. Each printhead 117 includes an ejection chamber and a corresponding orifice through which printing fluid is ejected from the ejection chamber.

Each printhead 117 receives printing fluid through a flow path from the printing fluid supplies 144 into and through the flow regulators 140 and slot(s) 116 in printbar 115 to fluid feed hole(s) (not shown) included in the printhead 117. The printing fluid can be ejected from a plurality of nozzles, as described herein, arranged in a primitive that is included in a printhead 117.

Figure 2:
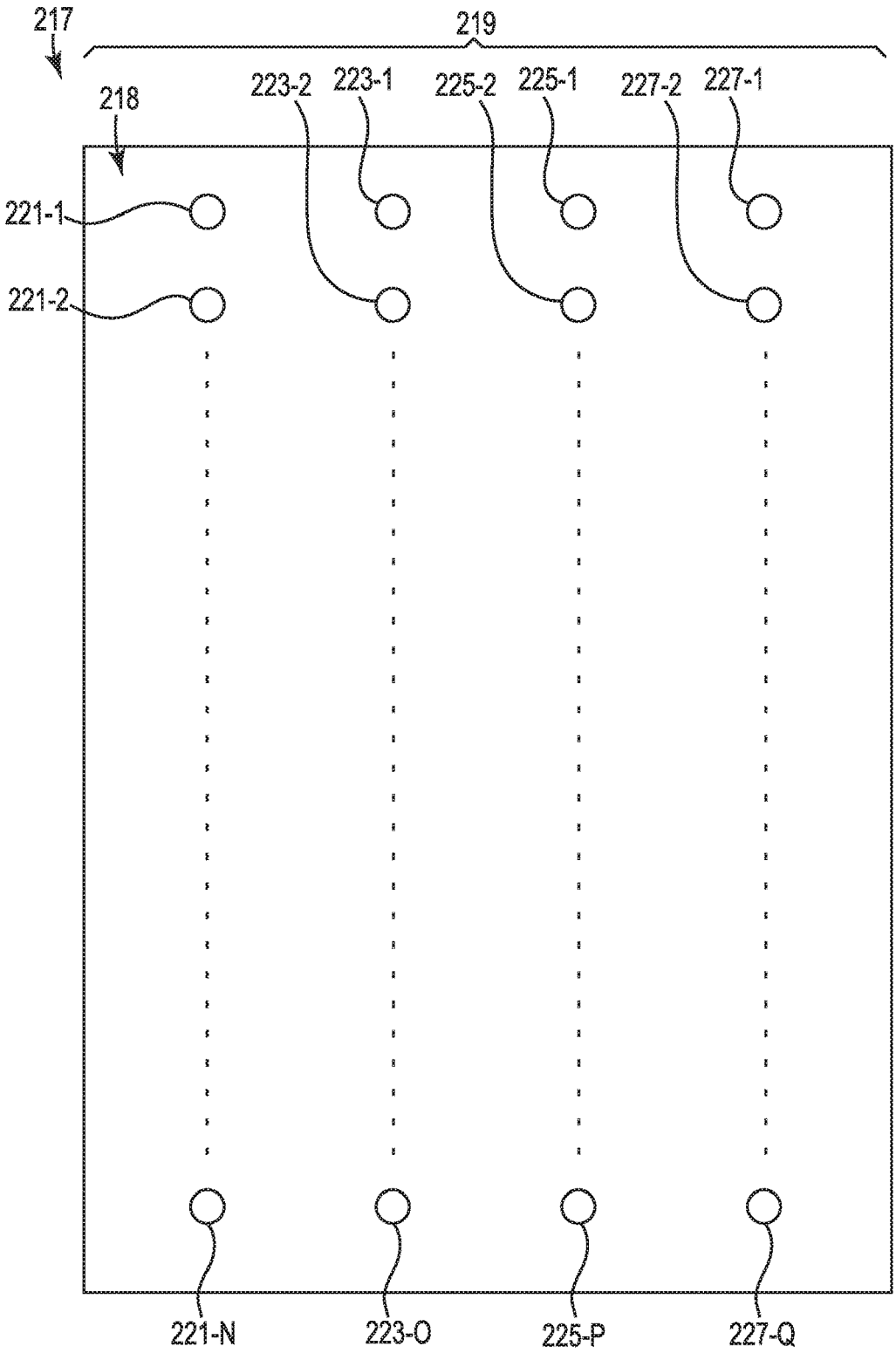
FIG. 2 is a plan view illustrating an example of a printhead for selecting nozzles according to the present disclosure.

FIG. 2 is a plan view illustrating an example of a printhead for selecting nozzles according to the present disclosure. Specifically, FIG. 2 illustrates a printhead 217 including a primitive 218 having a plurality of nozzles 219 arranged therein. The primitive 218 can include between 32-112 nozzles per primitive. For example, a primitive can include 96 nozzles per primitive, in contrast to other primitives which may be limited to no more than 20 nozzles per primitive due to firing/timing constraints associated with relying upon sending firing reservations to each of a plurality of nozzles in the primitive to print a print job regardless of whether a particular nozzle is fired to print the print job. Advantageously, having a greater number of addresses per primitive, compared to approaches that rely upon sending firing reservations to each of a plurality of nozzles regardless of whether the nozzle is to be fired, can result in comparatively smaller amount of data being needed to print a print job. Such a reduction in data can translate to relatively smaller circuit interconnects between the nozzles and other electrical components, among other advantages. Additional advantages can be realized by having more than one address assigned per nozzle and/or sending blanks to some but not all of the plurality of nozzles, for example, to reduce cross-talk.

The plurality of nozzles 219 can be arranged in parallel sets of nozzles (e.g., columns of nozzles), for example. The plurality of nozzles 219, as illustrated in FIG. 2, are arranged into four respective sets of nozzles illustrated as including nozzles 221-1, 221-2, . . . , 221-N; 223-1, 223-2, . . . , 223-O; 225-1, 225-2, . . . , 225-P; and 227-1, 227-2, . . . , 227-Q, respectively. Each set of nozzles can correspond to a particular color of fluid (e.g., black ink). For example, the four sets described above can correspond to black, cyan, yellow, and magenta colored fluids, respectively. Other arrangements including providing more or less colors of fluid to more or less sets of nozzles are possible. The plurality of nozzles 219 can be arranged in multiple columns and/or no columns, staggered or not staggered depending on a design of the nozzles. More specifically, examples are not limited to column, parallel columns, etc. That is, while FIG. 2 illustrates a single primitive having four sets of nozzles the present disclosure is not so limited. For example, a single color (e.g., a black fluid) can be provided to each of the nozzles. In some examples, the plurality of nozzles are not staggered. The printhead 217 can include a suitable number of primitive(s), set(s) of nozzles, and/or be provided suitable color(s) of fluid, among other features to promote selecting nozzles.

The plurality of nozzles 219 can each be designated by an address. A set of addresses can make up a primitive. For example, a primitive can include 20 addresses that each designates a nozzle location. While a single primitive 218 is illustrated in FIG. 2, a printhead can include a number of primitives. The printbar can be designed to connect with a printer through electrical interconnects (not shown), etc. that provide power and/or data to the printhead 217.

The nozzles can each be associated with a firing chamber (not shown). The plurality of nozzles 219 can be arranged in a particular order and/or can be fired in a particular order. For example, for a printhead with a plurality of nozzles including four sets of four nozzles, represented by 1, 2, 3, and 4, associated with respective colors, represented by K, C, M, and Y, respectively, as shown in Table 1. The "peak n" refers to a threshold (e.g., maximum) number of nozzles that are sent a firing reservation during a firing cycle (e.g., before printing a page of a print job). As shown Table 1, the peak n is equal to a total number of the plurality of nozzles and coincides with a comparatively greater amount of data being sent to the printhead in contrast to selecting nozzles, as described herein. The greater amount of data may employ a greater amount of costly circuitry than an amount of circuitry associated with selecting nozzles when transmitting data and/or power to/from the nozzles.

Moreover, data associated with approaches that send firing reservations to each of the plurality of nozzles may not be sent to the nozzles in the same order as the nozzle firing on the printhead, but rather in an unchanging predetermined order (e.g., beginning with a nozzle represented by K1 and progressing successively for each nozzle to the right until reaching the nozzle represented by Y4) which located in memory (hard-wired) into the printhead circuits. For example, the firing order may employ sending zeros (e.g., blanks), corresponding to firing reservations that are not used to fire a nozzle receiving the zero, to each of a number of non-firing nozzles included in a plurality of nozzles.

TABLE 1

| Peak n | | | | 16 | | | | | | | | | | | |
|---|---|---|---|---|---|---|---|---|---|---|---|---|---|---|---|
| Predetermined | K | K | K | K | C | C | C | C | M | M | M | M | Y | Y | Y | Y |
| Data Order | 1 | 2 | 3 | 4 | 1 | 2 | 3 | 4 | 1 | 2 | 3 | 4 | 1 | 2 | 3 | 4 |
| Actual Data | 1 | 1 | 1 | 1 | 0 | 0 | 0 | 0 | 0 | 0 | 0 | 0 | 0 | 0 | 0 | 0 |

Table 1 displays information corresponding to an example of data sent to a printhead including four sets of four nozzles per respective color to print a print job. More specifically, Table 1 displays the comparatively greater amount of data overhead (e.g., sending firing reservations to each of a plurality of nozzles) represented by an peak n of 16. Note that zeros are sent to all non-firing nozzles. The zeros correspond to firing reservations sent to nozzles that are not fired. Such sending of data can be associated with extra circuitry and/or difficulties associated with unchanging predetermined data transmission order. Such difficulties are avoided with selecting nozzles, as described herein.

Selecting nozzles can include selecting a firing order of the selected nozzles. For example, the fire order can be based upon a number of considerations including ensuring a desired amount of color separation between different colors of fluid, ensuring a desired amount of color separation within a particular color of fluid (e.g., separation between ejections of fluid of two or more nozzles printing the same color of fluid), among other considerations. In some examples, the firing order can include sending a number of zero(s) in firing reservations associated with the selected nozzles, for instance, to minimize cross-talk among the selected nozzles.

TABLE 2

| Peak n | | | 8 | | | | | |
|---|---|---|---|---|---|---|---|---|
| Actual Data | C1-0 | M1-0 | K1-1 | K3-1 | K2-1 | K4-1 | Y1-0 | K1-0 |

Table 2 displays information corresponding to an example of data sent to a printhead including four sets of four nozzles per color using an example of selecting nozzles to print a print job (the same print job as referenced in Table 1). Table 2 displays, an example of selecting nozzles where a peak n is determined to be 8. The present disclosure is not so limited. The peak n can be determined to be a value less than a total number of the plurality of nozzles. Notably, with the peak n of 8, even when all 8 firing reservations are sent to the selected nozzles still uses only half of the 16 firing reservations utilized in Table 1. Note that zeros are only sent to some of the nozzles that are not fired for a particular print job and/or firing sequence. This reduction in firing reservations corresponds to a reduction in data sent to the printhead that can enable a comparatively smaller amount of circuitry to be associated with the printhead, among other benefits.

Figure 3:
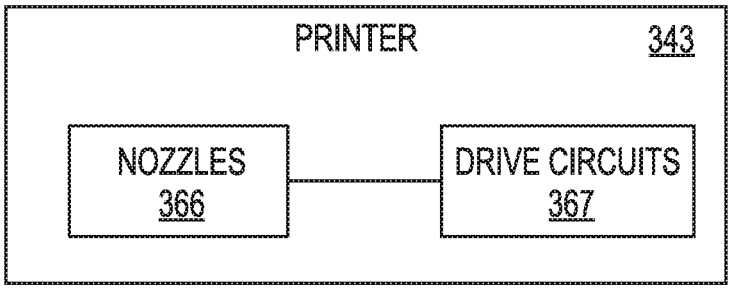
FIG. 3 illustrates a block diagram of an example rudimentary printer according to the present disclosure.

FIG. 3 illustrates a block diagram of an example of a printer 343. The printer may be analogous to printing device 143 described with respect to FIG. 1. The printing device 343 may be an inkjet-printing device, such as a printer, that ejects fluid onto media, such as paper, to form images, which can include text, on the media.

The printing device 343 (e.g., a piezoelectric inkjet printhead) includes a plurality of ejection nozzles 366, such as those described herein, and corresponding drive circuits 367. Each drive circuit (e.g., a controller) of the drive circuits 367 can correspond to a single nozzle of the plurality of ejection nozzles 366, although each ejection nozzle of the plurality of nozzles 366 may have more than one drive circuit 367.

The drive circuits 367 may be analogous to the controller described with respect to FIG. 1 and/or may be implemented on a circuit layer of the printhead. As a particular example, the drive circuit 367 may reside as part of a complementary metal-oxide semiconductor (CMOS) layer of the printhead. The drive circuits 367 can produce an ejection waveform(s) that can be applied globally (e.g., a golden waveform) or to individual ejection nozzles, for example, though use of a voltage scale memory (not shown), a voltage scale (not shown), an arbitrary waveform generator (AWG) (not shown), an amplifier (not shown), a lookup table (not shown), a digital to analogue converter (DAC) (not shown), and/or a protective ground (PGND) (not shown), among other possible components to promote nozzle selection. An ejection waveform can be sent to a selected nozzle to cause the selected nozzle to fire. For instance, the ejection waveform(s) can be sent to a selected nozzle(s) in a particular firing order, such as those described herein.

Figure 4:
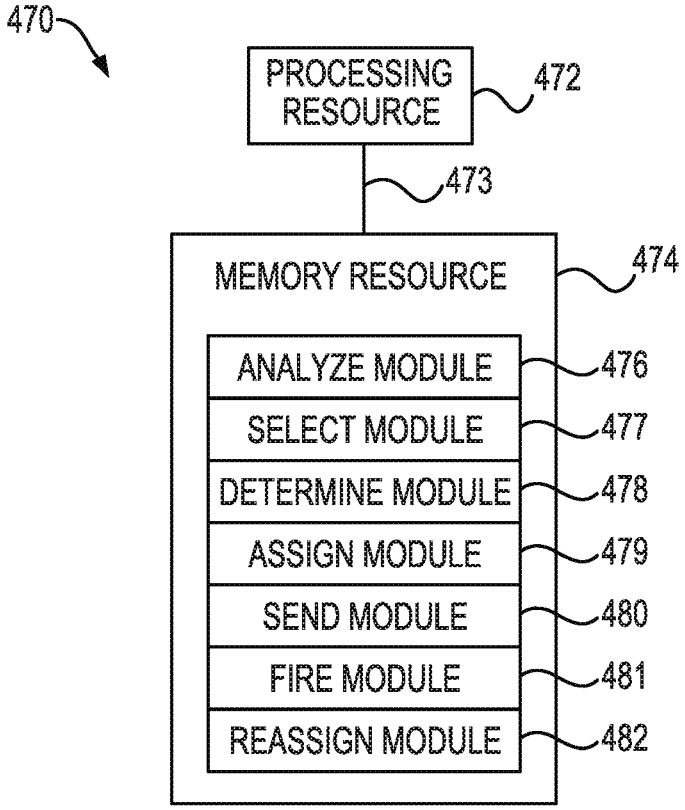
FIG. 4 illustrates a diagram of an example of a system for selecting nozzles according to the present disclosure.

FIG. 4 illustrates a diagram of an example of a system 470 for selecting nozzles according to the present disclosure. A system 470 can utilize software, hardware, firmware, and/or logic to perform a number of functions. The system 470 can be a combination of hardware and program instructions to select nozzles. The hardware, for example can include a processing resource 472, a memory resource 474 (e.g., computer-readable medium (CRM)). Processing resource 472, as used herein, can include a number of processing resources capable of executing instructions stored by a memory resource 474. Processing resource 472 may be integrated in a single device or distributed across devices. The program instructions (e.g., computer-readable instructions (CRI)) can include instructions stored on the memory resource 474 and executable by the processing resource 472 to implement a desired function (e.g., select nozzles of the plurality of nozzles to print the print job based on the content of the print job, etc.).

The memory resource 474 can be in communication with a processing resource 472. A memory resource 474, as used herein, can include a number of memory components capable of storing instructions that can be executed by processing resource 472. Such memory resource 474 can be a non-transitory CRM. Memory resource 474 may be integrated in a single device or distributed across devices. Further, memory resource 474 may be fully or partially integrated in the same device as processing resource 472 or it may be separate but accessible to that device and processing resource 472. The system 470 may be implemented on a printhead, as described herein.

The processing resource 472 can be in communication with a memory resource 474 storing a set of CRI executable by the processing resource 472, as described herein. The CRI can also be stored in remote memory managed by a server and represent an installation package that can be downloaded, installed, and executed.

Processing resource 472 can execute CRI that can be stored on an internal or external memory resource 474. The processing resource 472 can execute CRI to perform various functions, including the functions described herein. For example, the processing resource 472 can execute CRI to select nozzles of the plurality of nozzles to print the print job based on the content of the print job.

The CRI can include a number of modules 476, 477, 478, 479, 480, 481, 482. The number of modules 476, 477, 478, 479, 480, 481, 482, can include CRI that when executed by the processing resource 472 can perform a number of functions. The number of modules 476, 477, 478, 479, 480, 481, 482 can be sub-modules of other modules. For example, an analyze module 476 and a select module 477 can be sub-modules and/or contained within the same computing device. In another example, the number of modules 476, 477, 478, 479, 480, 481, 482 can include individual modules at separate and distinct locations (e.g., CRM, etc.).

In various examples, the system can include an analyze module 476. An analyze module 476 can include CRI that when executed by the processing resource 472 can prepare content of a print job sent to a printer including a printhead having a plurality of nozzles arranged in a primitive. The plurality of nozzles can include a total number of the plurality of nozzles in a range of from 32 nozzles to 128 nozzles arranged in the primitive, however, the total number of nozzle can be vary to promote selecting nozzles.

A select module 477 can include CRI that when executed by the processing resource 472 can perform a number of selecting functions. The select module 477 can include instructions to select nozzles of the plurality of nozzles to print the print job based on the content of the print job. The instructions can, for example, be stored in an internal or external non-transitory CRM coupled to the printing device (e.g., the printer 343 as illustrated in FIG. 3) that can execute instructions stored in the internal or non-transitory external CRM.

The system can include a determine module 478. A determine module 478 can include CRI that when executed by the processing resource 472 can provide a number of determining functions. The determine module 478 can determine a peak number of the selected nozzles, as described herein, to print the print job.

An assign module 479 can include CRI that when executed by the processing resource 472 can perform a number of assigning functions. An assign module 479 can assign a number of firing reservations to a first set of addresses associated with a first set of the selected nozzles, for instance, where a total number of the firing reservations (the firing reservations assigned) is no more than the peak number of the selected nozzles.

In some examples, the system can include a send module 480. The send module can send firing data to the plurality of nozzles. For instance, the send module 480 can send firing data only to the first set of selected nozzles to reduce an amount of firing data sent to the plurality of nozzles. In some examples, the send module 480 can send firing data to the selected nozzles that can include a sequence of firing data sent to at least two of the first set of selected nozzles simultaneously. For example, a sequence of firing data can be sent to a nozzle and another nozzle in a first set of selected nozzles (e.g., the nozzle and the another nozzle both corresponding to a black color).

A fire module 481 can include CRI that when executed by the processing resource 472 can perform a number of firing functions. Fire module 481 can fire the first set of the selected nozzles based on the firing data to print a portion of the print job (e.g., a page of a print job).

The system can include a reassign module 482. The reassign module 482 can reassign at least some of the firing reservations to a second set of addresses associated with a second set of the selected nozzles. Such reassignment can facilitate shifting firing reservations between selected nozzles during the course of printing a print job and/or prior to printing a print job, for instance, to reduce an amount of firing data (e.g., firing reservations) sent to the plurality of nozzles, and/or reduce the amount of fluidic cross-talk, among other advantages. Reassignment can be performed in response to firing the first set of the selected nozzles, for example.

The memory resource 474 can be integral, or communicatively coupled, to a computing device, in a wired and/or a wireless manner. For example, the memory resource 474 can be an internal memory, a portable memory, a portable disk, or a memory associated with another computing resource (e.g., enabling CRIs to be transferred and/or executed across a network such as the Internet).

The memory resource 474 can be in communication with the processing resource 472 via a communication path 473. The communication path 473 can be local or remote to a computing device) associated with the processing resource 472. Examples of a local communication path 473 can include an electronic bus internal to a computing device where the memory resource 474 is one of volatile, non-volatile, fixed, and/or removable storage medium in communication with the processing resource 472 via the electronic bus.

The communication path 473 can be such that the memory resource 474 is remote from the processing resource (e.g., 472), such as in a network connection between the memory resource 474 and the processing resource (e.g., 472). That is, the communication path 473 can be a network connection. Examples of such a network connection can include a local area network (LAN), wide area network (WAN), personal area network (PAN), and the Internet, among others. In such examples, the memory resource 474 can be associated with a first computing device and the processing resource 472 can be associated with a second computing device (e.g., a Java® server). For example, a processing resource 472 can be in communication with a memory resource 474, where the memory resource 474 includes a set of instructions and where the processing resource 472 is designed to carry out the set of instructions.

Figure 5:
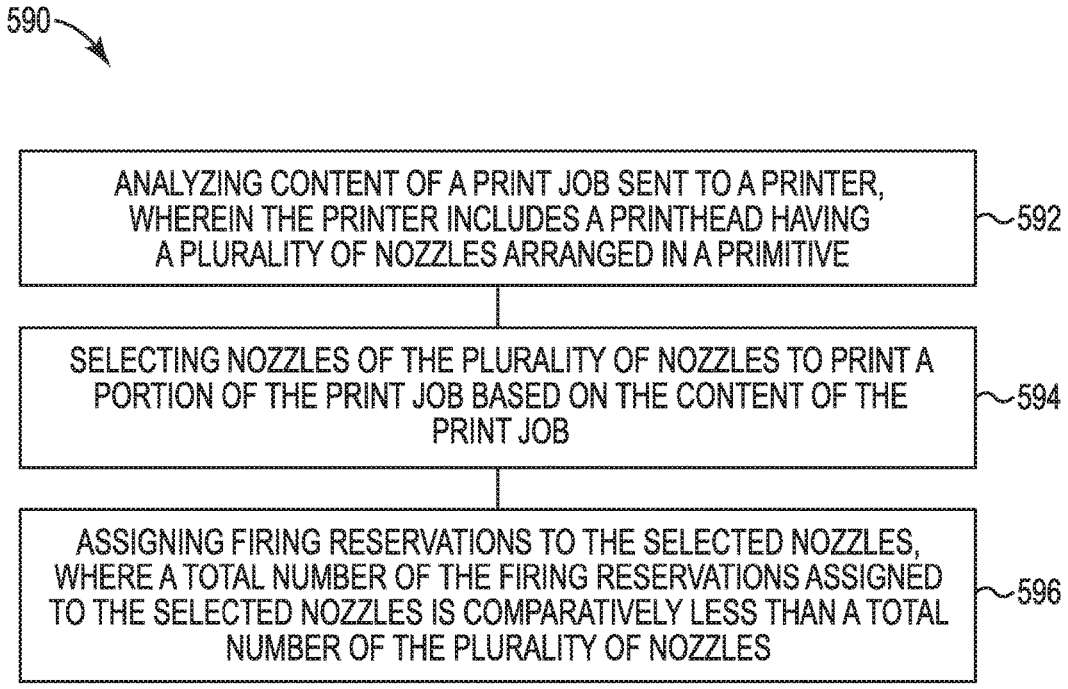
FIG. 5 is an example of a method for selecting nozzles according to the present disclosure.

FIG. 5 is an example of a method for selecting nozzles according to the present disclosure. As shown at 592, the method 590 can include analyzing content of a print job sent to a printer, for instance, where the printer includes a printhead (e.g., a print head included in a printbar) having a plurality of nozzles arranged in a primitive. For example, content included in a print job, such as each of a number of pages included in the print job can be analyzed prior to printing the print job. Such analyzing can include analyzing page dot density (e.g., a dot distribution map) of the print job, among other data included in a print job. The print job can be analyzed while in a printing queue, for example, in a printing queue including a number of print jobs to be printed and/or can be analyzed during spooling of the print job, among other suitable times before printing.

The method 590 can include selecting nozzles of the plurality of nozzles to print the print job based on the content of the print job, as shown at 594. Such selection can include selecting nozzles to print some or all of a print job. For example, a plurality of nozzles at locations that correspond (e.g., map) to target locations on a print substrate for producing a desired images(s) can be selected. For instance, in some examples, selecting nozzles can include selecting some but not all of the plurality of nozzles arranged in the primitive. In this manner, a plurality of selected nozzles can be fired in a particular firing order that can vary during printing of a print job and/or between different print jobs.

As shown at 596, the method 590 can include assigning firing reservations to the selected nozzles. For example, a total number of the firing reservations assigned to the selected nozzles can be comparatively less than a total number of the plurality of nozzles. For instance, in some examples, the total number of the firing reservations assigned can be no more than (e.g., equal) to a peak number of the selected nozzles, such as those described at 594, during printing of the print job (e.g., during a particular firing sequence of the print job). A time associated with the peak number of the selected nozzles can correspond to a time associated with a peak amount of data (e.g., a peak number of firing reservations including firing instructions to fire/not fire each of the selected nozzles) sent to the plurality of nozzles arranged in a primitive. Again, such a peak amount of data is comparatively less than an amount of data associated with sending firing reservations to each of the plurality of nozzles (e.g. for each given firing sequence).

The method 590 can, in some examples, include assigning firing reservations across a plurality of sets of nozzles. That is, the selected nozzles can include a plurality of sets of nozzles. For example, as described with respect to FIG. 2 in greater detail, a plurality of selected nozzles can include a plurality of sets of nozzles such that each set has a respective color (e.g., black, cyan, yellow, and magenta colored fluids) associated therewith. Advantageously and in contrast to approaches that assign firing reservations to each nozzle, assigning firing reservations across a plurality of sets of nozzles (e.g., selected nozzles) can comparatively reduce a number of firing reservations sent to the plurality of nozzles and/or enable firing reservations (e.g., a peak number of firing reservations) to be shifted (e.g., reassigned) between the plurality of set of nozzles.

For example, if a particular print job and/or particular page of a print job does not include a color(s) associated with a respective set(s) of nozzles then firing reservations can be shifted away from that set of nozzles to other sets of nozzles that have a respective color associated therewith that is included in the print job and/or a particular page of a print job. Such assignment of firing reservations across a plurality of sets of nozzles can reduce an amount of data (e.g., an overall number of firing reservations sent during a firing sequence) to a plurality of nozzle during a given firing sequence of a print job and/or over the course of the entire print job, among other advantages. In some examples, a first set of selected nozzles can corresponds to a first color, where a second set of selected nozzles can corresponds to a second color, and where the first color and the second color are different colors included in a plurality of colors.

In some examples, the method 590 can include sending firing data to the selected nozzles assigned firing reservations in an order in the same order as a firing order of the selected nozzles. Firing data can include firing instructions (e.g., a "1" to fire a nozzle and/or a "0" to not fire a nozzle), a location corresponding to a nozzle (e.g., a row and/or column), and/or a firing order, as described herein. For example, firing instructions can, in some examples, include a row and/or a column corresponding to a respective address associated with a selected nozzle of the selected nozzles (e.g., of each of the selected nozzles assigned firing reservations).

The method 590 can include selecting a firing order of the selected nozzles, for instance, selecting a firing order of selected nozzles assigned firing reservations. A firing order refers to a number of times (e.g., a sequence of times), for example corresponding to a firing sequence during printing of a print job, in which the plurality of selected nozzles are fired and/or not fired at a particular time depending upon a firing instruction sent to a particular selected nozzle of the plurality of selected nozzles. A firing order can be selected in response to selecting nozzles of the plurality of nozzles to print the print job based on the content of the print job, for example.

The method 590 can include sending firing data, for example, firing data including the firing order, to the each of the selected nozzles assigned firing reservations. For instance, the firing data can be sent in the same order as the firing order of the selected nozzles assigned firing reservations. Firing data (e.g., firing instructions to fire or not fire a particular selected nozzle) can be transmitted only to the selected nozzles, not to non-selected nozzles included in the plurality of nozzles and/or not to selected nozzles that do not fire for a particular firing sequence (e.g., non-firing nozzles for a particular page of a print job). Non-selected nozzles refer to nozzle of the plurality of nozzles that do not eject fluid during printing of the print job.

In some examples, firing data can include a respective firing instruction for each of the selected nozzles assigned firing reservations. Such respective firing instructions can include a firing instruction corresponding to a blank (e.g., a "0" and/or a combination of multiple "0"s) that can be assigned to a selected nozzle. Such firing instructions to not fire (e.g., a blank) can be introduced into a particular firing cycle for a variety of purposes including reducing cross-talk. Selected nozzles that do not fire for a particular sequence can be fired for a different firing sequence (e.g., a different firing sequence corresponding to a different page and/or target location on a page) during printing of a print job. In some examples, respective firing instruction for each of the selected nozzles assigned firing reservations includes a firing instruction corresponding to a blank for a selected nozzle The figures herein follow a numbering convention in which the first digit or digits correspond to the drawing figure number and the remaining digits identify an element or component in the drawing. As will be appreciated, elements shown in the various examples herein can be added, exchanged, and/or eliminated so as to provide a number of additional examples of the present disclosure. In addition, the proportion and the relative scale of the elements provided in the figures are intended to illustrate the examples of the present disclosure, and should not be taken in a limiting sense. As used herein, "a number of" an element and/or feature can refer to one or more of such elements and/or features. In addition, "for example" and similar phrasing is intended to mean, "by way of example and not by way of limitation".

The specification examples provide a description of the applications and use of the system and method of the present disclosure. Since many examples can be made without departing from the spirit and scope of the system and method of the present disclosure, this specification sets forth some of the many possible example configurations and implementations.

What is claimed is:

1. A method comprising:

in a controller of a printer, analyzing content of a print job sent to the printer, wherein the printer comprises a print bar to span the width of a print substrate, and the print bar comprises a printhead having a plurality of nozzles arranged in a primitive;

the controller selecting a first set of nozzles of the plurality of nozzles to print a portion of the print job on the print substrate based on the content of the print job;

the controller assigning firing reservations to the selected first set of nozzles, wherein a total number of the firing reservations assigned to the selected first set of nozzles is comparatively less than a total number of the plurality of nozzles;

the controller sending firing data only to the selected first set of nozzles to reduce an amount of firing data sent to the plurality of nozzles;

the controller firing the selected first set of nozzles based on the firing data to print a portion of the print job on the print substrate; and the controller reassigning at least some of the firing reservations to a second set of addresses associated with a selected second set of nozzles of the plurality of nozzles.

2. The method of claim 1, wherein the print bar comprises a plurality of printheads including the printhead having the plurality of nozzles.

3. The method of claim 1, wherein the controller comprises an application specific integrated circuit (ASIC).

4. The method of claim 1, wherein:

the selected first set of nozzles includes a plurality of sets of nozzles;

assigning firing reservations includes assigning the firing reservations across the plurality of sets of nozzles; and each set of nozzles of the plurality of sets of nozzles has a respective color associated therewith.

5. The method of claim 1, wherein selecting the first set of selected nozzles includes selecting some but not all of the plurality of nozzles arranged in the primitive.

6. The method of claim 1, wherein the total number of the firing reservations assigned is no more than a peak number of the selected first set of nozzles sent firing reservations during printing of the portion of the print job.

7. The method of claim 1, including sending firing data to the first set of selected nozzles assigned firing reservations in an order that is the same as a firing order of the first set of selected nozzles.

8. The method of claim 1, wherein analyzing the content includes analyzing a page dot density of the print job.

9. The method of claim 8, further comprising the controller selecting the selected first set of nozzles based on the analysis of the page dot density.

10. The method of claim 1, wherein the print bar further comprises a second printhead comprising a plurality of nozzles arranged in a primitive, the method further comprising:

the controller selecting a first set of selected nozzles of the plurality of nozzles of the second printhead to print a portion of the print job on the print substrate based on the content of the print job;

the controller assigning firing reservations to the selected first set of nozzles of the second printhead, wherein a total number of the firing reservations assigned to the selected first set of nozzles of the second printhead is comparatively less than a total number of the plurality of nozzles of the second printhead;

the controller sending firing data only to the selected first set of nozzles of the second printhead to reduce an amount of firing data sent to the plurality of nozzles of the second printhead;

the controller firing the selected first set of nozzles of the second printhead based on the firing data to print another portion of the print job on the print substrate; and the controller reassigning at least some of the firing reservations assigned to the selected first set of nozzles of the second printhead, comprising reassigning the fire reservations to a second set of addresses associated with a selected second set of nozzles of the second printhead.

11. A system comprising:

a print bar to span the width of a print substrate, wherein the print bar comprises a printhead having a plurality of nozzles arranged in a primitive; and a controller to:

analyze content of a print job sent to a printer;

select a first set of nozzles of the plurality of nozzles to print a portion of the print job on the print substrate based on the content of the print job;

assign firing reservations to the selected first set of nozzles, wherein a total number of the firing reservations assigned to the selected first set of nozzles is comparatively less than a total number of the plurality of nozzles;

send firing data only to the selected first set of nozzles to reduce an amount of firing data sent to the plurality of nozzles;

fire the selected first set of nozzles based on the firing data to print a portion of the print job on the print substrate; and reassign at least some of the firing reservations to a second set of addresses associated with a selected second set of nozzles of the plurality of nozzles.

12. The system of claim 11, wherein the controller comprises an application specific integrated circuit (ASIC).

13. The system of claim 11 wherein the print bar further comprises at least one additional printhead.

14. The system of claim 11, further comprising:

flow regulators to route printing fluid from at least one printing fluid supply to the printhead.

15. The system of claim 11, wherein:

the selected first set of nozzles includes a plurality of sets of nozzles;

each set of nozzles of the plurality of sets of nozzles has a respective color associated therewith; and the controller assigns the firing reservations across the plurality of sets of nozzles.

16. The system of claim 11, wherein the controller selects some but not all of the plurality of nozzles arranged in the primitive.

17. The system of claim 11, wherein the controller assigns the firing reservations such that the total number of assigned firing reservations is no more than a peak number of the selected first set of nozzles to which the controller sent firing reservations during printing of the portion of the print job.

18. The system of claim 11, wherein the controller sends firing data to the selected first set of nozzles assigned firing reservations in an order that is the same as a firing order of the first set of selected nozzles.

19. The system of claim 11, wherein the controller analyzes a page dot density of the print job and selects the selected first set of nozzles based on the analysis of the page dot density.

20. The system of claim 11, wherein the print bar further comprises a second printhead comprising a plurality of nozzles arranged in a primitive, and the controller to:

select a first set of selected nozzles of the plurality of nozzles of the second printhead to print a portion of the print job on the print substrate based on the content of the print job;

assign firing reservations to the selected first set of nozzles of the second printhead, wherein a total number of the firing reservations assigned to the selected first set of nozzles of the second printhead is comparatively less than a total number of the plurality of nozzles of the second printhead;

send firing data only to the selected first set of nozzles of the second printhead to reduce an amount of firing data sent to the plurality of nozzles of the second printhead;

fire the selected first set of nozzles of the second printhead based on the firing data to print another portion of the print job on the print substrate; and reassign at least some of the firing reservations assigned to the selected first set of nozzles of the second printhead, comprising reassigning the fire reservations to a second set of addresses associated with a selected second set of nozzles of the second printhead.

* * * * *